US006125134A

United States Patent [19]

Jönsson et al.

[11] Patent Number: 6,125,134

[45] Date of Patent: Sep. 26, 2000

[54] ELECTRIC FURNACE ASSEMBLY

[75] Inventors: Bo Jönsson, Västerås; Thomas Lewin, Hallstahammar; Jonas Magnusson, Västerås, all of Sweden

[73] Assignee: Kanthal AB, Hallstahammar, Sweden

[21] Appl. No.: 09/297,330

[22] PCT Filed: Oct. 30, 1997

[86] PCT No.: PCT/SE97/01819

§ 371 Date: Jun. 30, 1999

§ 102(e) Date: Jun. 30, 1999

[87] PCT Pub. No.: WO98/19500

PCT Pub. Date: May 7, 1998

[30] Foreign Application Priority Data

Oct. 30, 1996 [SE] Sweden ..... 9603965

[51] Int. Cl.[7] ..... H05B 3/66

[52] U.S. Cl. ..... 373/128; 373/119; 373/130

[58] Field of Search ..... 373/109, 117, 373/118, 119, 120, 122, 127, 128, 130, 134, 131

[56] References Cited

U.S. PATENT DOCUMENTS

| | | | |
|---|---|---|---|
| 1,597,900 | 8/1926 | Keene | 373/130 |
| 2,035,306 | 3/1936 | Fannin | 373/130 |
| 2,896,004 | 7/1959 | Duffy et al. . | |
| 4,056,678 | 11/1977 | Beall, III et al. | 373/130 |
| 4,142,062 | 2/1979 | Wentworth | 373/130 |
| 5,497,394 | 3/1996 | Jhawar et al. | 373/130 |
| 5,930,285 | 7/1999 | Moller | 373/128 |

FOREIGN PATENT DOCUMENTS 389958 11/1976 Sweden .

OTHER PUBLICATIONS

Kanthal Handbook—Resistance Heating Alloys and Elements for Industrial Furnaces by Kanthal AB Sweden, 1994.

*Primary Examiner*—Tu Ba Hoang
*Attorney, Agent, or Firm*—Birch, Stewart, Kolasch & Birch, LLP

[57] ABSTRACT

An electric furnace assembly includes an elongated metallic resistor element, which is supported adjacent to a furnace wall. The resistor element is bent back and forth in its longitudinal direction and is retained by fixed holding member at positions located furthest away from the furnace wall so as to permit a controlled elongation of the resistor element.

19 Claims, 10 Drawing Sheets

ELECTRIC FURNACE ASSEMBLY

CROSS REFERENCES TO RELATED APPLICATIONS

This application is the national phase under 35 U.S.C. § 371 of PCT International Application No. PCT/SE97/01819 which has an International filing date of Oct. 30, 1997, which designated the United States of America.

STATEMENT REGARDING FEDERALLY SPONSORED RESEARCH OR DEVELOPMENT

Not Applicable

BACKGROUND OF THE INVENTION

1. Field of the Invention

The present invention concerns an electric furnace assembly, comprising at least one furnace wall and an elongated metallic resistor element being supported so as to extend adjacent to said furnace wall, said metallic resistor element being bent back and forth in its longitudinal direction so as to extend at a varying distance from said furnace wall between extreme positions located at relatively large and relatively small distances therefrom.

2. Description of the Related Art Including Information Disclosed Under 37 CFR 1.97 AND 1.98

Such assemblies are generally known, e.g. as disclosed in the Swedish patent specification 389958 (Allmanna Svenska Elektriska AB), being designed for heat treatment of objects at high temperature, such as exceeding 1000° C., and at high pressure, preferably exceeding 500 bar (50 MPa). In this known furnace, the elongated metallic resistor element is formed as a strip which is bent in a meander-like fashion, so that the flat resistor element is oriented with its flat side standing vertically, and the lower, longitudinal edge resting on the horizontal bottom surface of an annular ceramic body mounted at the inside of the cylindrical insulating wall of the furnace. Several annular support bodies with associated resistor elements are stacked one on top of the other so as to obtain a high power density and a uniform temperature within the furnace chamber.

In other previously known electric furnace assemblies, there are elongated resistor elements being embedded in the wall. Alternatively, coiled elements are supported by ceramic cores extending along the centre of the coil. See the KANTHAL® Handbook, Catalogue 1-a-5b-3, September 1994, illustrating various alloys, wire and strip elements and support systems for electric elements in furnaces.

Generally, in furnaces of this kind, the resistor elements are subject to thermal expansion and contraction during temperature changes. There is also a risk of permanent deformation, so that the dimensions of the resistor element change upon extensive use. Normally, the resistor elements are permanently elongated.

BRIEF SUMMARY OF THE INVENTION

The main object of the present invention is to overcome these problems and to provide an electric furnace assembly, wherein the resistor elements have a high degree of form stability, even after long use, and to allow for thermal expansion and contraction in a controlled way without causing any hazard of physical contact between any parts of the resistor element and the objects being treated in the furnace chamber.

Additional, secondary objects are to secure an efficient transport of thermal energy from the resistor element into the furnace chamber, to secure a long element life and to provide resistor elements which are chemically inert, which have a low thermal mass in order to allow for rapid temperature changes and which are inexpensive to manufacture and assemble, in particular resistor elements in the form of wire, strip or rod material with circular, oval or rectangular cross-section.

The main object stated above is achieved in that the resistor element is retained at fixed points by fixed holding members at some of said extreme positions, located at said relatively large distances from the furnace wall, so as to permit a controlled elongation of the resistor element while keeping the latter within a limited region adjacent to the furnace wall.

The resistor element is preferably bent back and forth in its longitudinal direction, e.g. in meander-like loops, and the element is retained by fixed holding members at the above-mentioned fixed points, viz. at the extreme positions located furthest away from the furnace wall. Accordingly, any thermal expansion and contraction will occur in a controlled way, the various loops being contracted or elongated like an accordion. Moreover, the supporting points are fixed and located in such a way that the loop-formed portions of the resistor element, which extend between two adjacent holding members, will not move into the furnace chamber (away from the furnace wall). Rather, these portions will remain within a limited region adjacent to the furnace wall, said limited region being preferably confined substantially inside line segments extending between said fixed points. The loop portions located closest to the furnace wall are not fixed and may therefore move somewhat closer to the furnace wall, possibly even into contact therewith. However, the overall dimensions of the resistor element are such that all the loop portions are retained within the limited region, even after long use. Thanks to the loops, elongation and contraction can occur without causing large forces or stresses in the resistor element material.

In principle, the portions of the resistor element extending between the fixed holding members may be supported by supporting brackets, shelves or the like. However, in a preferred embodiment of the invention, the resistor element has a flattened cross-section with the largest dimension oriented substantially in a vertical direction, e.g. in the form of a strip. With such an embodiment, the resistor element may extend freely between successive holding members, without hanging down considerably therebetween.

Further embodiments, features and advantages will appear from the detailed description below.

BRIEF DESCRIPTION OF THE SEVERAL VIEWS OF THE DRAWING

The invention will be explained more fully below with reference to the appended drawings.

FIG. 1*a* shows fixed discrete points of loop portions of the heating element according to the present invention;

DETAILED DESCRIPTION OF THE INVENTION

Figure 1:
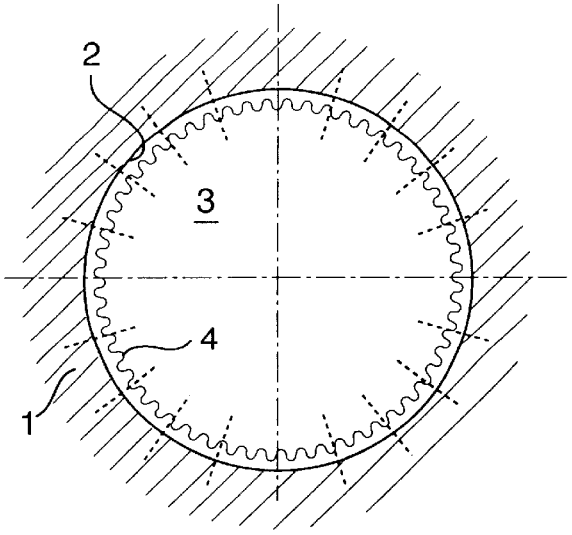
FIGS. 1 and 1*a* show a horizontal sectional view, an electric furnace assembly according to the invention.
Figure 11A:
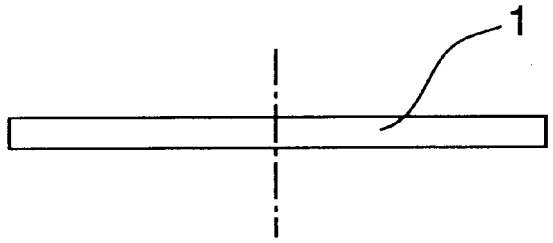
FIGS. 11*a* and 11*b* illustrate schematically, in a top view and a side view, respectively, a planar furnace wall (without the electric resistor elements)
Figure 11B:
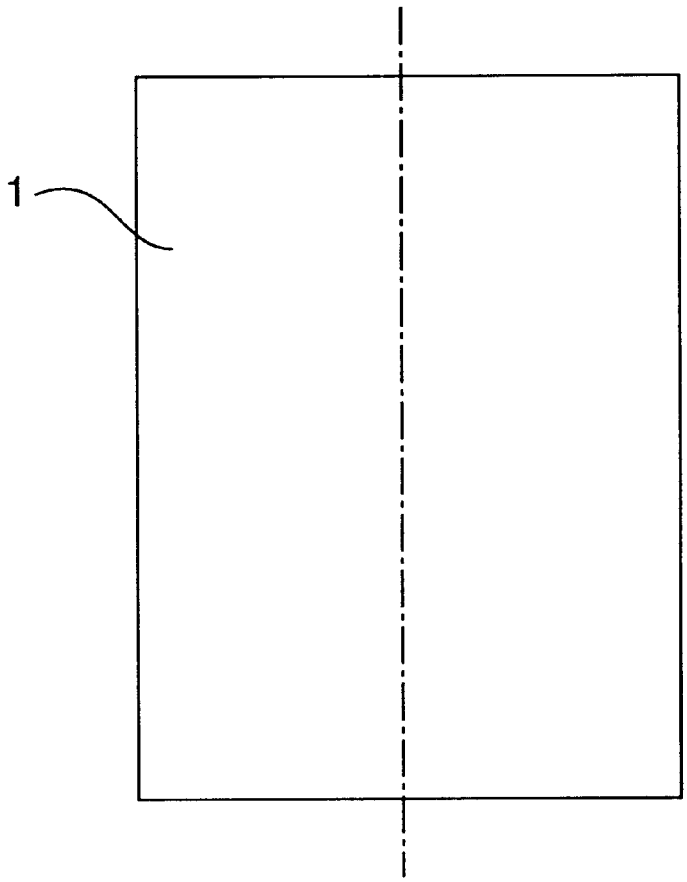
Figure 12A:
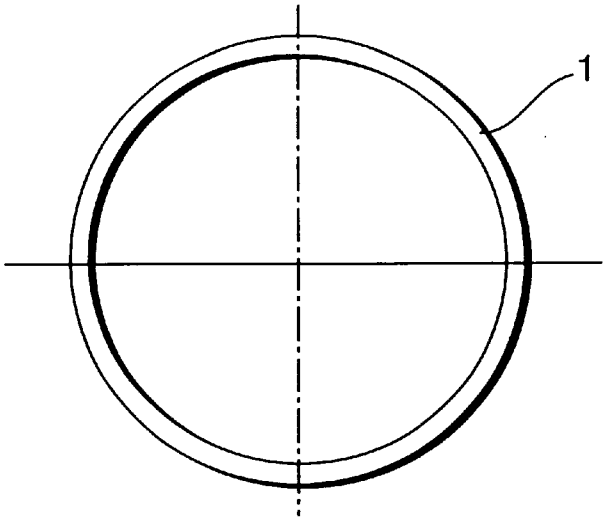
FIGS. 12*a* and 12*b* illustrate schematically, in a top view and a vertical section, respectively, a furnace chamber (without the electric resistor elements)
Figure 12B:
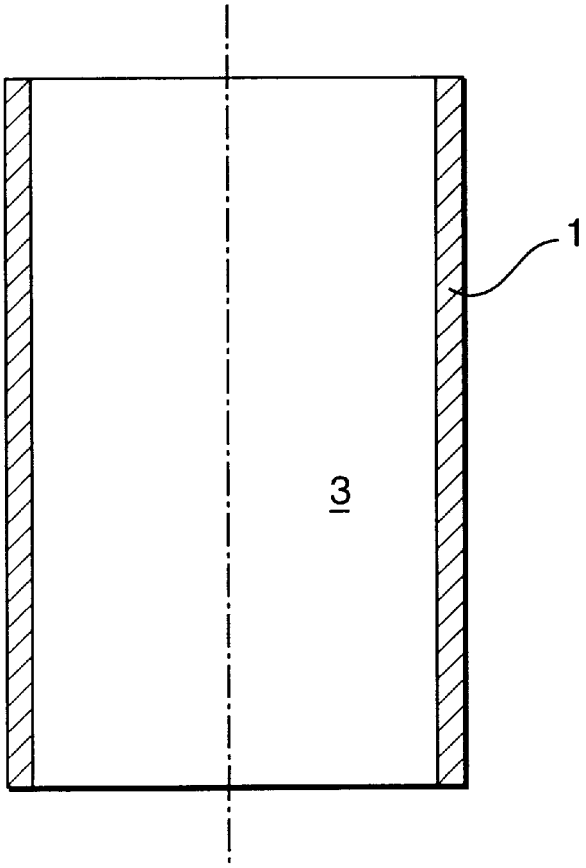
Figure 13A:
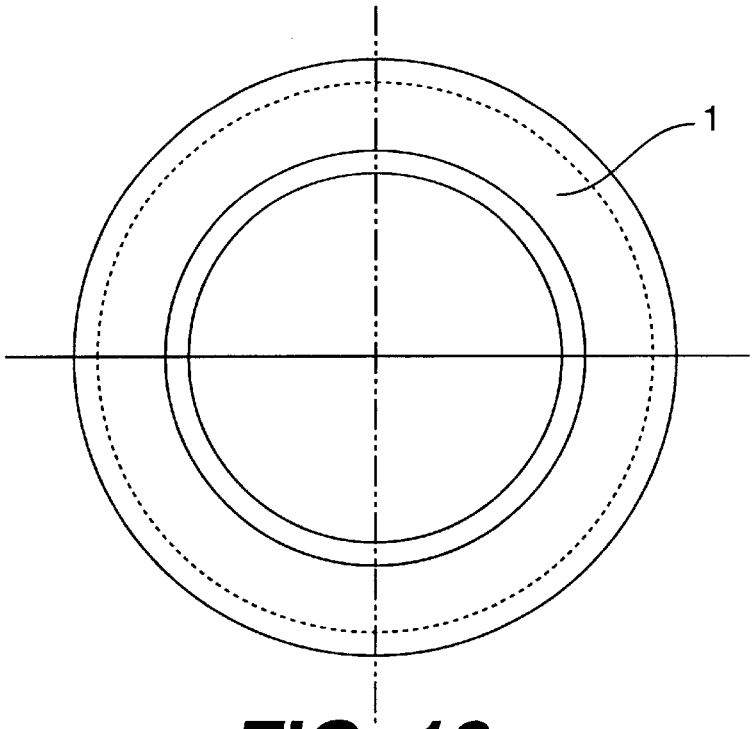
FIGS. 13*a* and 13*b* illustrate a second embodiment of the furnace chamber.
Figure 13B:
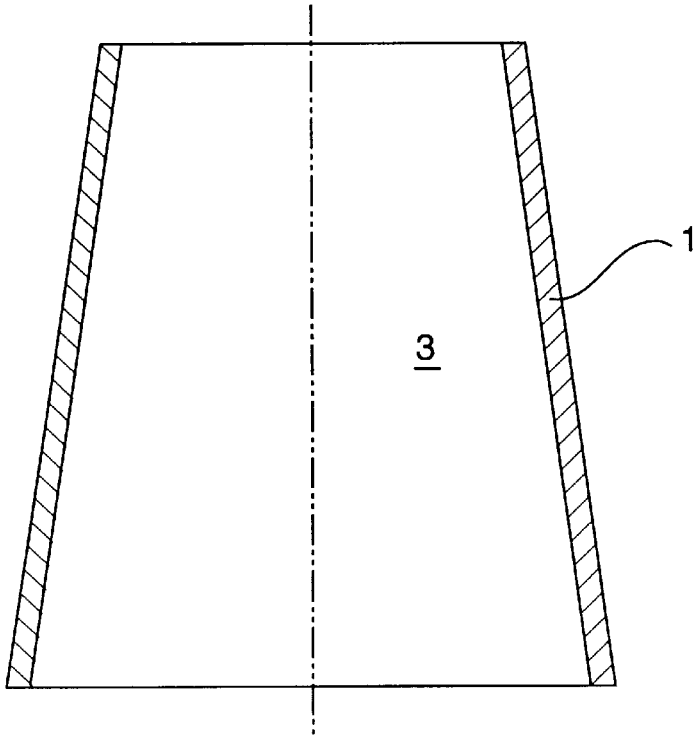
Figure 14A:
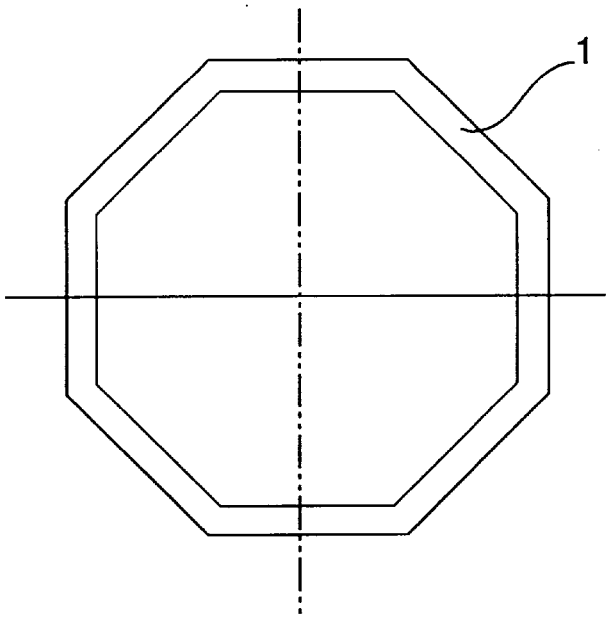
FIGS. 14*a* and 14*b* illustrate a third embodiment of the furnace chamber.
Figure 14B:
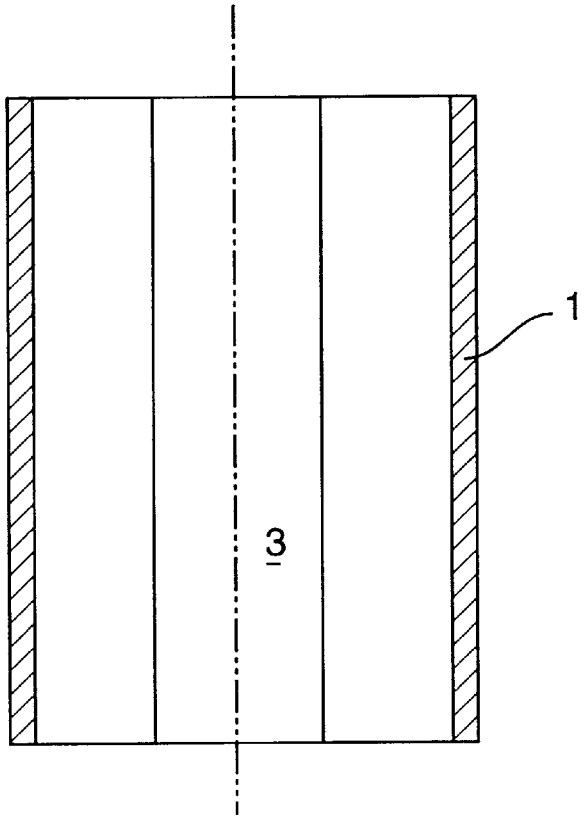
Figure 15A:
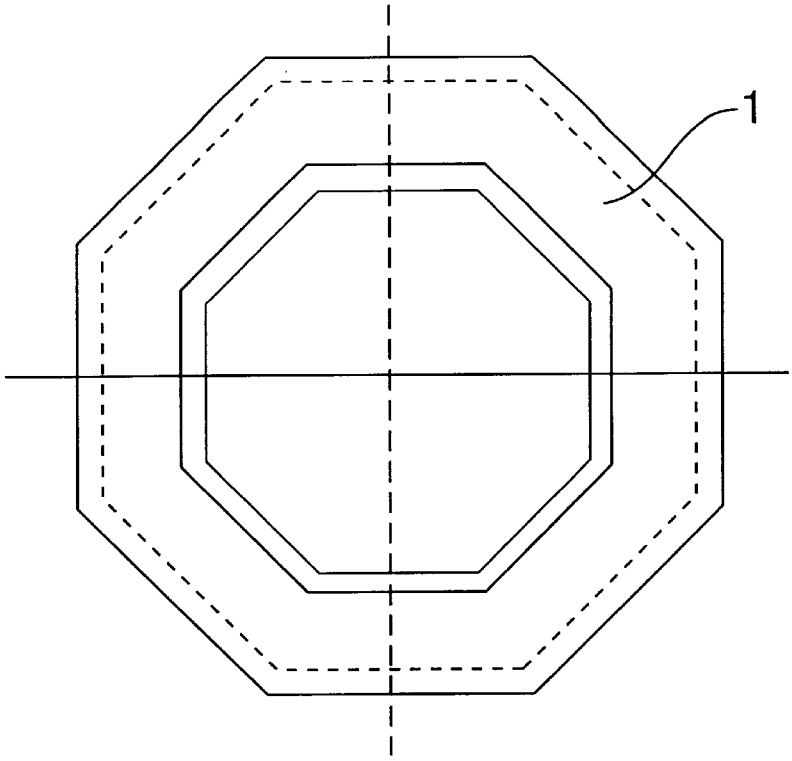
FIGS. 15*a* and 15*b* illustrate a fourth embodiment of the furnace chamber.
Figure 15B:
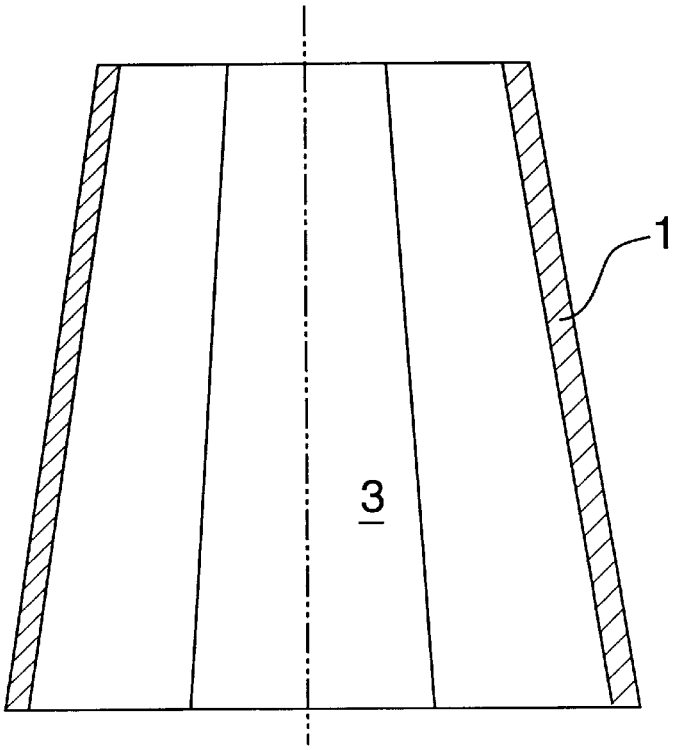

In FIG. 1 there is shown a cylindrical furnace wall 1 having a cylindrical inside surface 2 defining a furnace chamber 3. The furnace chamber may have any desired configuration, e.g. cylindrical as shown in FIGS. 12*a* and 12*b*, conical, as shown in FIGS. 13*a* and 13*b*, a vertically extending chamber with a constant polygonal cross-section as shown in FIGS. 14*a* and 14*b*, or an upwardly tapering chamber with polygonal cross-sections as shown in FIGS. 15*a* and 15*b*. Alternatively, the furnace wall 1 may be planar (FIGS. 11*a*, 11*b*) so as to form a heat radiating panel. The furnace wall 1 is made of a heat insulating material, such as a ceramic material in the forms of bricks, or a fibre-insulated composite material.

Figure 2:
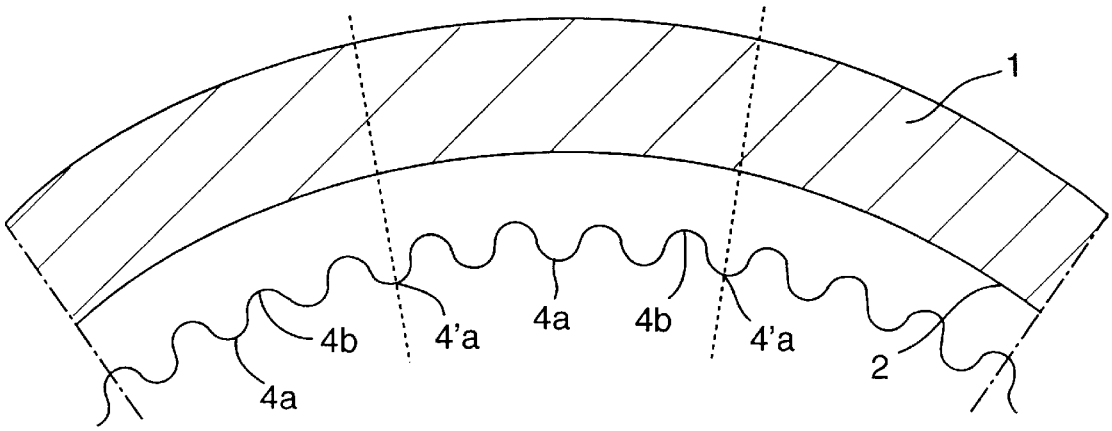
FIG. 2 shows, in a larger scale, a portion of the assembly shown in FIG. 1.

In the embodiment illustrated in FIGS. 1 and 2, the furnace chamber is closed at the top and at the bottom by roof and bottom wall parts, respectively (not shown). Adjacent to the inside wall surface 2, there is mounted an electric resistor element 4. The resistor element 4 has the overall configuration of a circular ring, a number of such rings being disposed on top of each other at different levels, each ring being provided with separate terminals (not shown) for leading an electric current through the resistor element 4 when using the furnace. As an alternative to several horizontal rings, the resistor element may have a substantially helical configuration with helical windings climbing upwards.

According to the invention, the resistor element 4 extends at a varying distance from the furnace wall along its longitudinal direction, e.g. in meander-like loops as illustrated in FIGS. 1 and 2. Furthermore, as show in FIG. 1*a* the resistor element 4 is supported at fixed, discrete points located at some 4'*a* of the loop portions 4*a* located furthest away from the internal wall surface 2. It is essential that these loop portions 4'*a* are securely fixed in position by holding members, examples of which are illustrated in FIGS. 3–10. Because of the corrugated shape of the resistor element 4 and the securely fixed portions 4'*a* thereof, the element 4 can be heated to a high temperature while being elongated in a controlled way. More particularly, while being elongated, the resistor element 4 will be confined within a limited area close to the wall surface 2. No point of the element 4 will move further away from the wall surface 2, and the loop portions between the fixed portions 4'*a* will be retained substantially in the same region. The opposite loop portions 4*b*, located closest to the wall surface 2, will move towards the wall surface 2. Normally, no portion of the resistor element 4 will move into direct contact with the wall surface 2. However, in special cases, a direct contact may occur provided that the shape and bending pattern allows for the permanent elongation of the resistor element.

As illustrated in FIGS. 3–10, the resistor element 4 is preferably formed as a strip with the flat side oriented substantially vertically. In this way, the element will have a high stiffness against being bent or deformed downwards between the points of support. Consequently, the resistor element portions between the fixed points can extend freely therebetween without being supported from underneath. So, upon being heated and elongated, these freely extending portions can be folded towards each other without causing any large forces or stresses in the material.

The resistor is preferably made from a resistance alloy with high temperature oxidation resistance. In the case of an oxidizing environment in the furnace, the resistance material is preferably selected from the groups of Fe—Cr—Al or Ni—Cr(Fe) alloys, well known to those skilled in the art. It is also well-known that such alloys will deform at working temperature due to high temperature creep. In situations where chemicals or particles originating from the element are harmful, Fe—Cr—Al alloys, possibly with added trace elements, are preferred due to the presence of a chemically stable and comparatively adhesive surface layer of $Al_2O_3$ that spontaneously forms on the resistor surface at operating temperature.

In cases, where there are relatively long portions extending freely between the points of support and where the heating is not uniform, there may be a risk that forces within a freely extending portion, generated by thermal expansion of the resistor element and/or a residual elongation thereof, may cause a bending moment resulting in a force on an adjacent freely extending portion. The latter force may be directed away from the furnace wall surface and cause a movement into the furnace chamber 3.

Figure 1A:
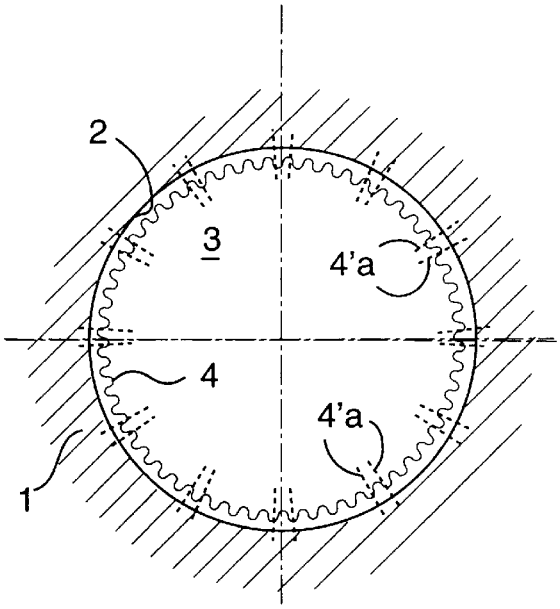

One way to avoid this and to retain the resistor element 4 in the limited area close to the wall surface, is to support the resistor element 4 at pair-wise distributed fixed points 4'*a*, each such pair including two consecutive extreme positions of said longitudinally extending resistor element, as illustrated generally in FIG. 1*a*. Another way is to secure the resistor element portions 4'*a* very firmly at each holding member (not shown), so that the bending moment cannot be transferred from one freely extending portion to an adjacent portion.

Accordingly, it should be understood that the various holding members to be described below with reference to FIGS. 3–10 can be arranged in pairs or be modified so as to firmly secure the various portions 4'*a*.

Figure 3:
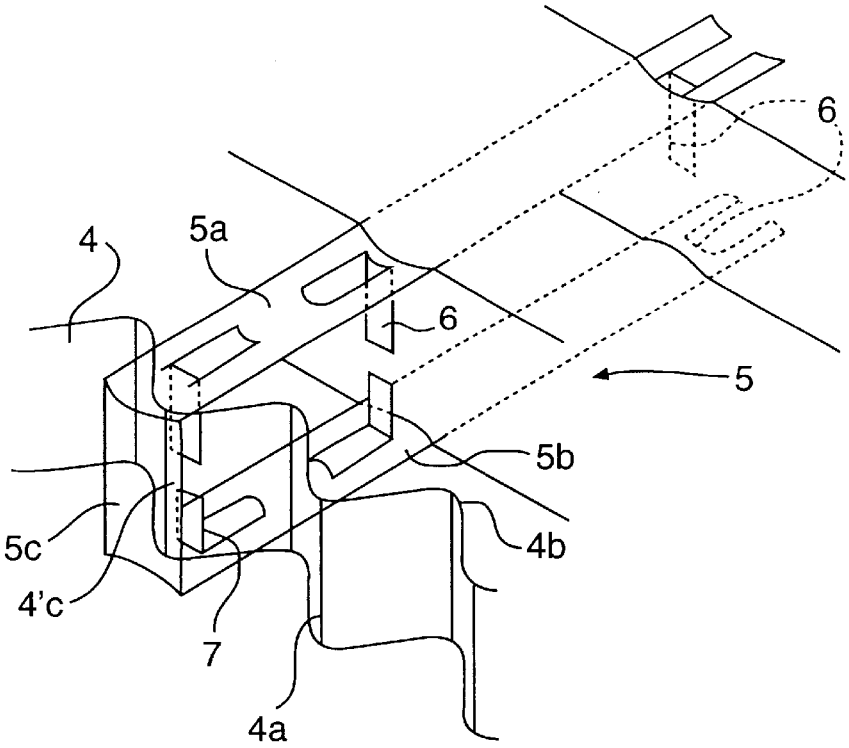
FIG. 3 shows, in a perspective view, a holding member in the form of a bracket.
Figure 4:
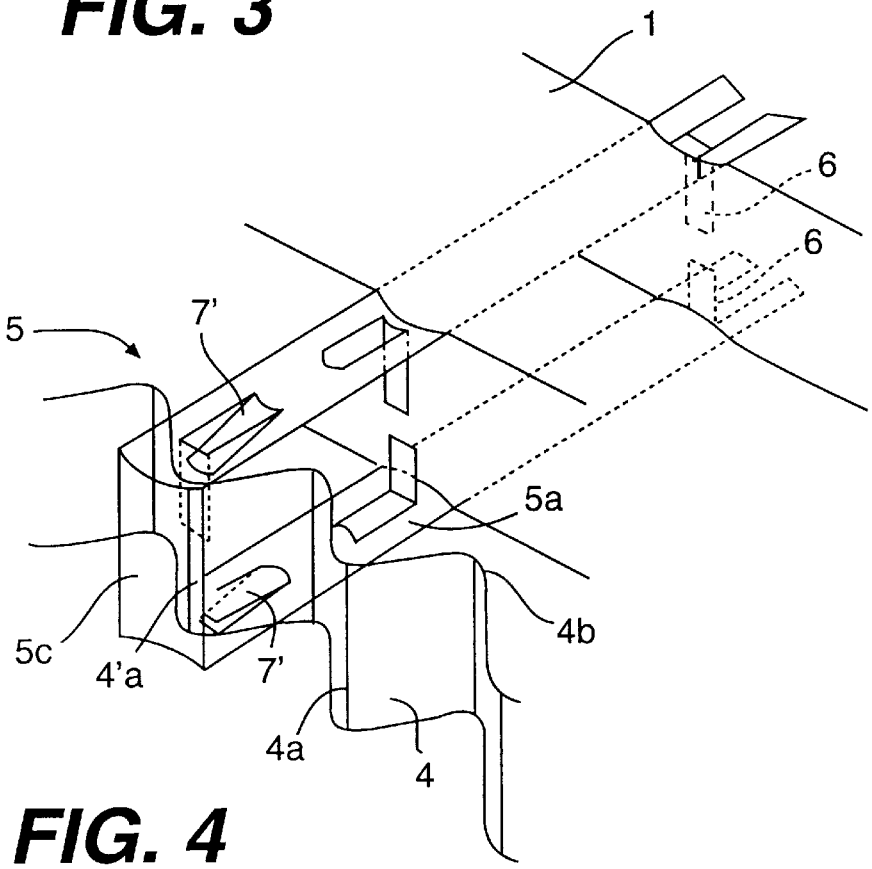
FIG. 4 shows a modified embodiment of the bracket according to FIG. 3.

The holding elements 5 shown in FIGS. 3 and 4 are formed by a high temperature resistant metallic strip material being bent into U-shape with an upper leg 5*a* and a lower leg 5*b* as well as a substantially vertical interconnecting portion 5*c*. The horizontal legs 5*a*, 5*b* are securely fixed to the wall brick 1 by means of tongues 6 being punched out from the strip material and being bent into fixing positions. Two further tongues 7 are located close to the interconnecting portion 5*c* and are bent in such a way as to securely hold the resistor element portion 4*a* in a fixed position. In FIG. 4, the fixing tongues 7' abut with their free ends against the resistor element portion 4*a*.

Figure 5:
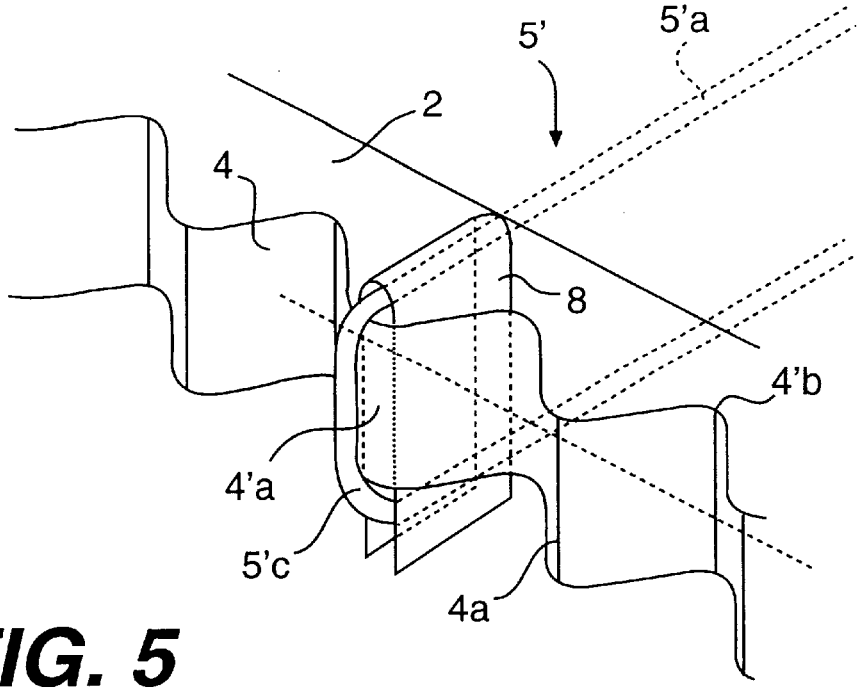
FIG. 5 shows, likewise in a perspective view, a third embodiment of a bracket.
Figure 6:
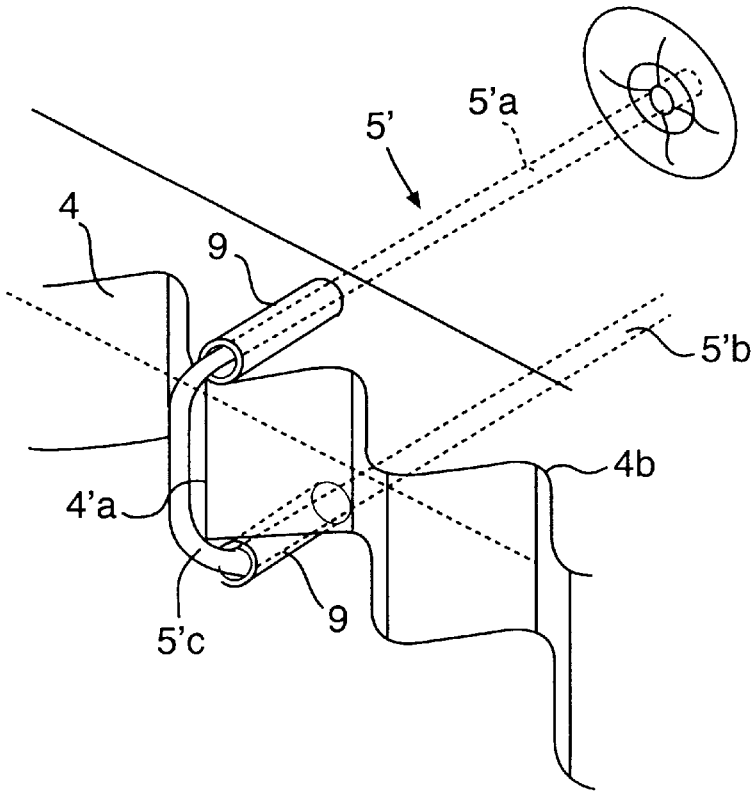
FIG. 6 shows a fourth embodiment of a bracket.

In FIGS. 5 and 6 the brackets 5' are likewise U-shaped but consist of a wire material with upper and lower legs 5'*a*, 5'*b* and an interconnecting portion 5*c*.

In FIG. 5, the fixing means consists of a strip member 8 which is folded around both legs of the bracket. The width of the strip member 8 is slightly less than the distance between the wall surface 2 and the selected position of the resistor element portion 4*a*. Hereby, the latter is securely held between the strip member 8 and the interconnecting portion 5'*c* of the bracket 5'. In the modified embodiment shown in FIG. 6, the fixing means comprises a tube member 9 mounted onto the upper and lower legs 5'*a*, 5'*b* of the bracket 5'.

Figure 7:
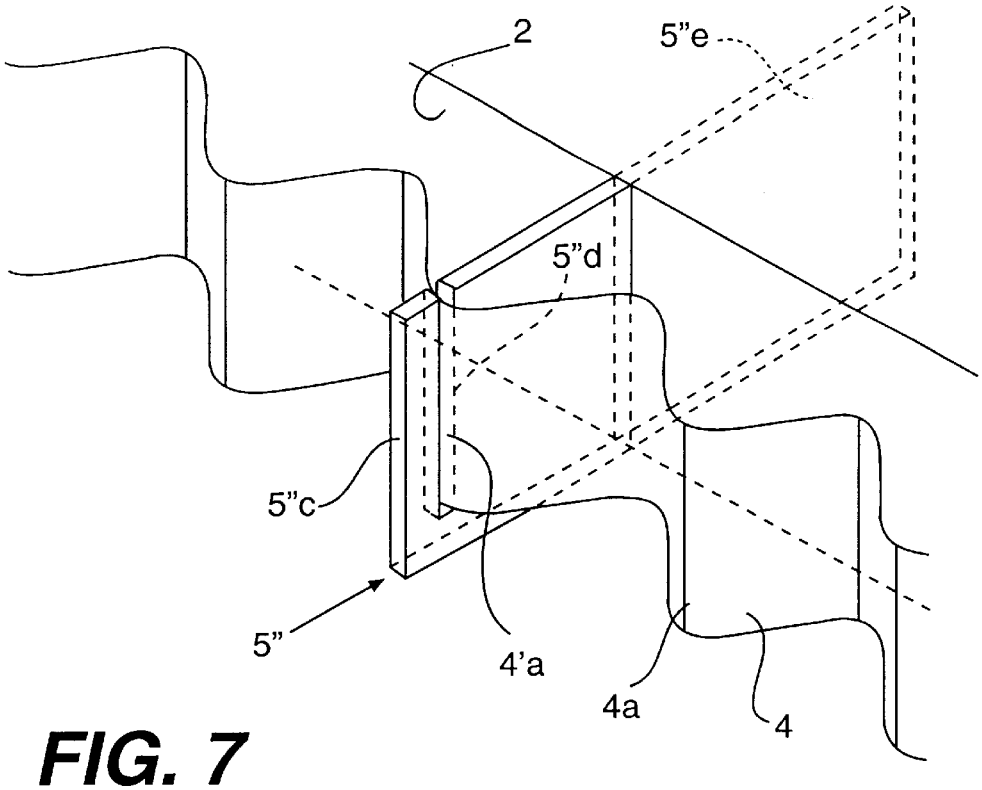
FIGS. 7–10 show fifth, sixth, seventh and eighth embodiments of a bracket.
Figure 8:
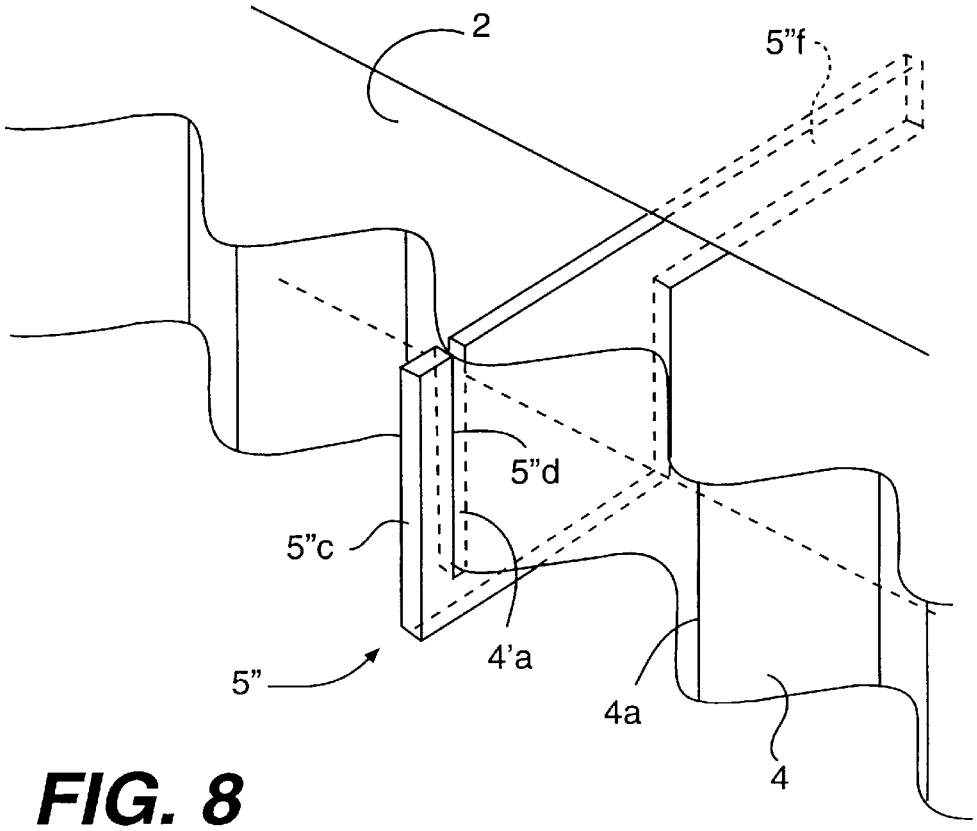
Figure 9:
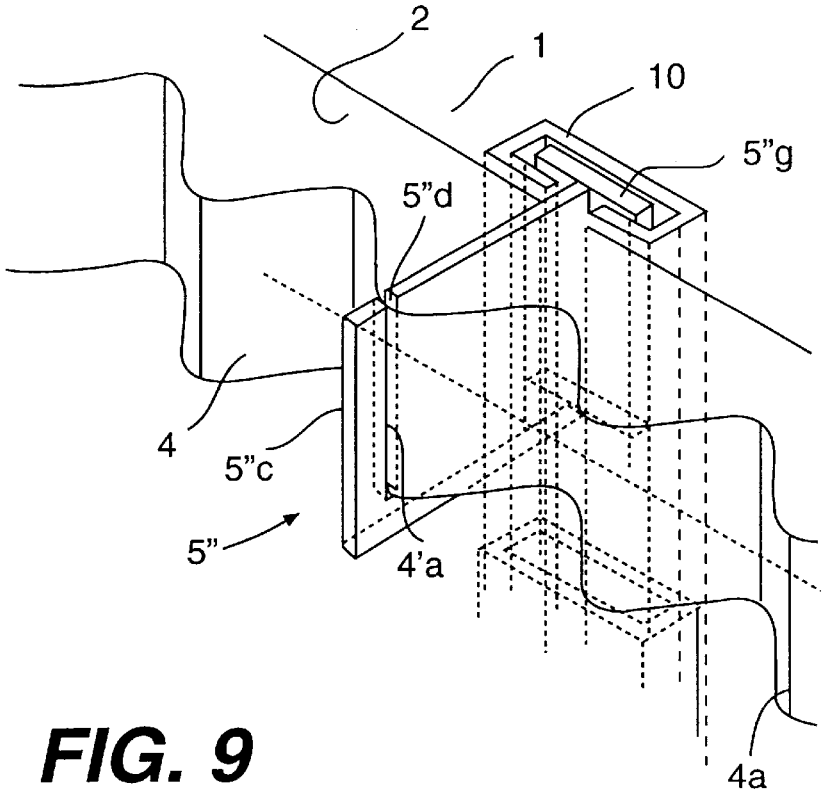

The brackets 5" shown in FIGS. 7,8 and 9 are made of a plate material extending at right angle straight out from the furnace wall 2, normally in a vertical plane. Adjacent to the free end 5"*c* of the bracket, there is a recess in the form of a slot 5"*d*, which is open at the top end at the upper edge of the bracket and is dimensioned to receive the resistor element loop portion 4*a*. The width of the slot 5"*d* is slightly larger than the thickness of resistor strip material. Accordingly, the resistor 4 is held firmly in position in the slot.

In FIG. 7 the bracket has an anchoring portion 5"*e* with the same height as the portion projecting outwardly from the wall 2. In FIG. 8, the anchoring portion 5"*f* is just as long but has a smaller height (normally in the vertical direction). The anchoring portion 5"*g* in the embodiment shown in FIG. 9 is formed in T-shape and is fitted into a corresponding guiding rail 10 mounted in the furnace wall 1.

Figure 10:
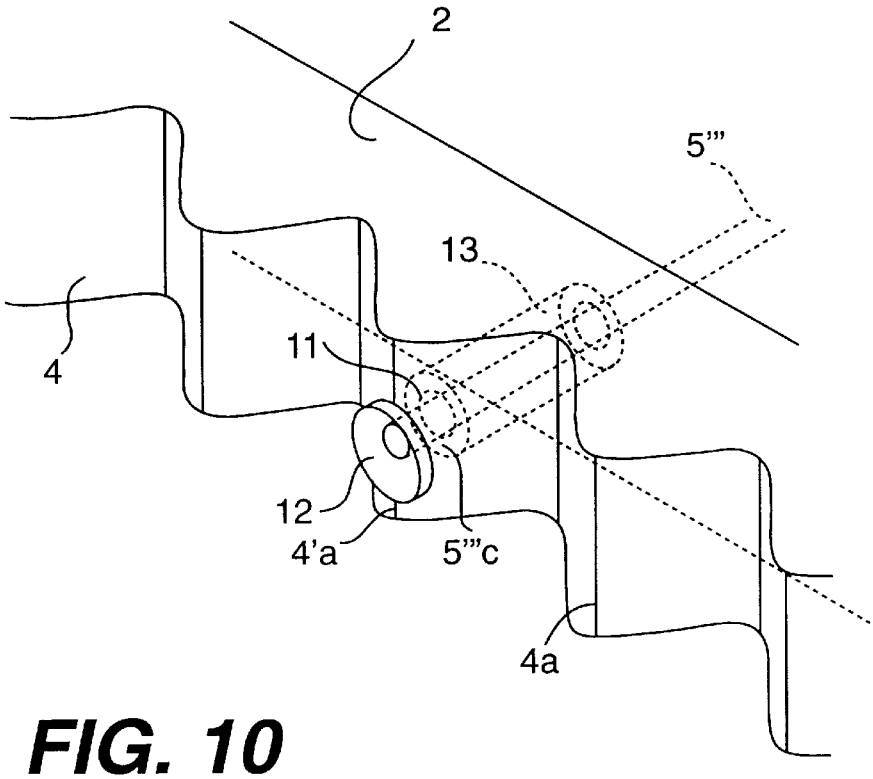

In FIG. 10, there is shown a further embodiment comprising a straight rod 5'", which projects perpendicularly from the wall surface 2. The free end portion 5'"*c* of the rod 5'" is fitted into a hole 11 made in the resistor element 4. At the outer end of the rod 5'", a stop washer 12 is fastened. The resistor element loop portion 4*a* is securely held between the stop washer 12 and a tube member 13 mounted onto the rod.

The illustrated embodiments of the electric furnace assembly may be modified in many ways within the scope of the invention. However, it is advantageous that the resistor element is corrugated or crinkled, e.g. in a zigzag or meander-like configuration, although a large number of bending patterns are possible. The corrugations give a higher electrical resistance and a larger surface area of the element in a given wall area. They also decrease the mechanical stiffness in the longitudinal direction. The local power concentration and the mechanical properties can also be controlled by varying the cross-sectional dimensions along the length of the resistor element, e.g. by introducing slits or holes or by a more or less gradual change of the width of the strip-formed resistor element.

The assembly according to the invention has many advantages. The increase in outer diameter of the resistor element 4, upon elongation, is much less than a strictly circular element. Therefore, the clearance outside the resistor can be reduced considerably, e.g. by 50%, whereby the size of the furnace can be reduced with associated lower energy consumption and smaller dimensions of the supporting brackets. Also, the clearance between the resistor element and the objects being treated in the furnace chamber can be decreased, since the possible elongation of the resistor element is handled in a controlled way, always away from these objects.

In case the resistor element is flat with a rather great width or height, the clearance between consecutive loops can be made relatively small because of the large stiffness in the vertical direction. Finally, because of the corrugations, the resistor will impose relatively small forces on the furnace wall, since most of the bending forces are taken up by the resistor element itself.

The furnace wall does not necessarily form a part of a closed furnace chamber but may constitute a radiating panel, e.g. located adjacent to a conveyor or a feeding mechanism for moving objects into a heating zone in front of the radiating panel. Compare FIGS. 11*a* and 11*b*.

Generally, the furnace wall may have any desired orientation, not only vertical or inclined.

As an alternative to separate brackets, the holding members may be constituted by elongated strip portions, which are bent out from the resistor element itself.

In principle, the furnace wall may be provided with curved portions between the fixed holding members. In such a case the "varying distance" between the resistor element and the furnace wall should be regarded as the distance between the element and a straight or a slightly curved line portion following the overall curvature of the furnace wall.

What is claimed is:

1. An electric furnace assembly, comprising at least one furnace wall and an elongated metallic resistor element being supported so as to extend adjacent to said furnace wall, said metallic resistor element being bent back and forth in its longitudinal direction so as to extend at a varying distance from said furnace wall, between extreme positions located at distal and proximal positions therefrom, said resistor element being retained at fixed points by fixed holding members, characterized in that said fixed holding members are adapted to fixedly hold said resistor element at said distal positions from said furnace wall, so as to permit a controlled elongation of said resistor element while keeping said resistor element within a limited region adjacent to said furnace wall, said limited region being confined substantially inside line segments extending between said fixed points, to thereby prevent the transfer of bending forces between adjacent portions of the resistor element.

2. An electric furnace assembly as defined in claim 1, wherein said at least one furnace wall is a part of a furnace chamber.

3. An electric furnace assembly as defined in claim 1, wherein the resistor element is supported at pair-wise distributed fixed points each such pair including two consecutive distal positions of said resistor element.

4. An electric furnace assembly as defined in claim 1 wherein said resistor element extends in regular loops between said distal positions.

5. An electric furnace assembly as defined in claim 4, wherein said loops are meander-like.

6. An electric furnace assembly as defined in claim 1, wherein said furnace wall is substantially vertically oriented.

7. An electric furnace assembly as defined in claim 1, wherein said resistor element has a flattened cross-section with the largest dimension of the cross-section oriented substantially in a vertical direction.

8. An electric furnace assembly as defined in claim 1, wherein said resistor element extends freely between successive fixed holding members.

9. An electric furnace assembly as defined in claim 1, wherein said holding members comprise high temperature resistant brackets projecting from said furnace wall.

10. An electric furnace assembly as defined in claim 9, wherein said brackets project substantially horizontally.

11. An electric furnace assembly as defined in claim 9 wherein each bracket is made of wire or strip material.

12. An electric furnace assembly as defined in claim 11, wherein said bracket is constituted by a rod, the end position of which fits into a hole in said resistor element.

13. An electric furnace assembly as defined in claim 11, wherein each bracket is U-shaped with two legs and an interconnecting portion defining an extreme position of said resistor element.

14. An electric furnace assembly as defined in claim 13, wherein a fixing means is adapted to be positioned adjacent to said interconnecting portion so as to hold said resistor element therebetween at said fixed point.

15. An electric furnace assembly as defined in claim 14, wherein said fixing means comprises a tongue being bent out from at least one leg of said bracket.

16. An electric furnace assembly as defined in claim 14, wherein said fixing means comprises a strip member folded around at least one leg of said bracket.

17. An electric furnace assembly as defined in claim 14, wherein said fixing means comprises a tube member mounted onto at least one leg of said bracket.

18. An electric furnace assembly as defined in claim 11, wherein said bracket is made of a straight element of strip material having a recess serving to secure said resistor element at said fixed points.

19. An electric furnace assembly as defined in claim 18, wherein said recess is a slot and said resistor element is formed as a corrugated strip.

* * * * *

UNITED STATES PATENT AND TRADEMARK OFFICE

CERTIFICATE OF CORRECTION

PATENT NO. : 6,125,134
DATED : September 26, 2000
INVENTOR(S) : Roger Berglund et al.

It is certified that error appears in the above-identified patent and that said Letters Patent is hereby corrected as shown below:

Title page,
Item [75], Inventors, please correct the inventor listing as follows:
-- Roger Berglund, Vasteras; Bo Jonsson, Vasteras; Thomas Lewin, Hallstahammar; Jonas Magnusson, Vasteras, all of Sweden --.

Signed and Sealed this

Eleventh Day of February, 2003

JAMES E. ROGAN
*Director of the United States Patent and Trademark Office*